United States Patent [19]

Doyle et al.

[11] Patent Number: 4,513,894

[45] Date of Patent: Apr. 30, 1985

[54] ABRASIVE SLURRY SUPPLY SYSTEM FOR USE IN METALLOGRAPHIC SAMPLE PREPARATION

[75] Inventors: Ralph R. Doyle, Des Plaines; Robert E. Zimmer, Niles, both of Ill.

[73] Assignee: Buehler Ltd., Lake Bluff, Ill.

[21] Appl. No.: 433,633

[22] Filed: Oct. 12, 1982

[51] Int. Cl.[3] ..... B24B 57/00

[52] U.S. Cl. ..... 222/644; 222/318; 51/263; 239/70; 239/124

[58] Field of Search ..... 222/644, 639, 318; 51/263, 292; 239/70, 124

[56] References Cited

U.S. PATENT DOCUMENTS

| | | | |
|---|---|---|---|
| 2,914,253 | 11/1959 | Jobus et al. | 239/124 X |
| 3,028,711 | 4/1962 | Campbell et al. | 239/124 X |
| 3,261,510 | 7/1966 | Day et al. | 222/318 |
| 4,059,929 | 11/1977 | Bishop | 51/292 X |

*Primary Examiner*—Joseph J. Rolla
*Assistant Examiner*—Frederick R. Handren
*Attorney, Agent, or Firm*—Charles F. Pigott, Jr.

[57] ABSTRACT

An alumina slurry supply system for use in conjunction with a polisher or grinder apparatus or the like for preparing the surfaces of metallurgical specimens, the system comprising an alumina slurry reservoir, a recirculation pump disposed in the reservoir, an applicator arm for dispensing the abrasive slurry to a platen or lapping wheel of the polisher or grinder apparatus, a first conduit for receiving slurry pumped from the reservoir, a second conduit connected to the first conduit for recirculating the slurry to the reservoir, a third conduit leading from the first conduit to the applicator arm, a valve in the third conduit movable between an open position to supply abrasive slurry to the applicator arm and a closed position in which all abrasive slurry pumped from the reservoir is recirculated thereto, and a timer for controlling the operation of the valve.

7 Claims, 1 Drawing Figure

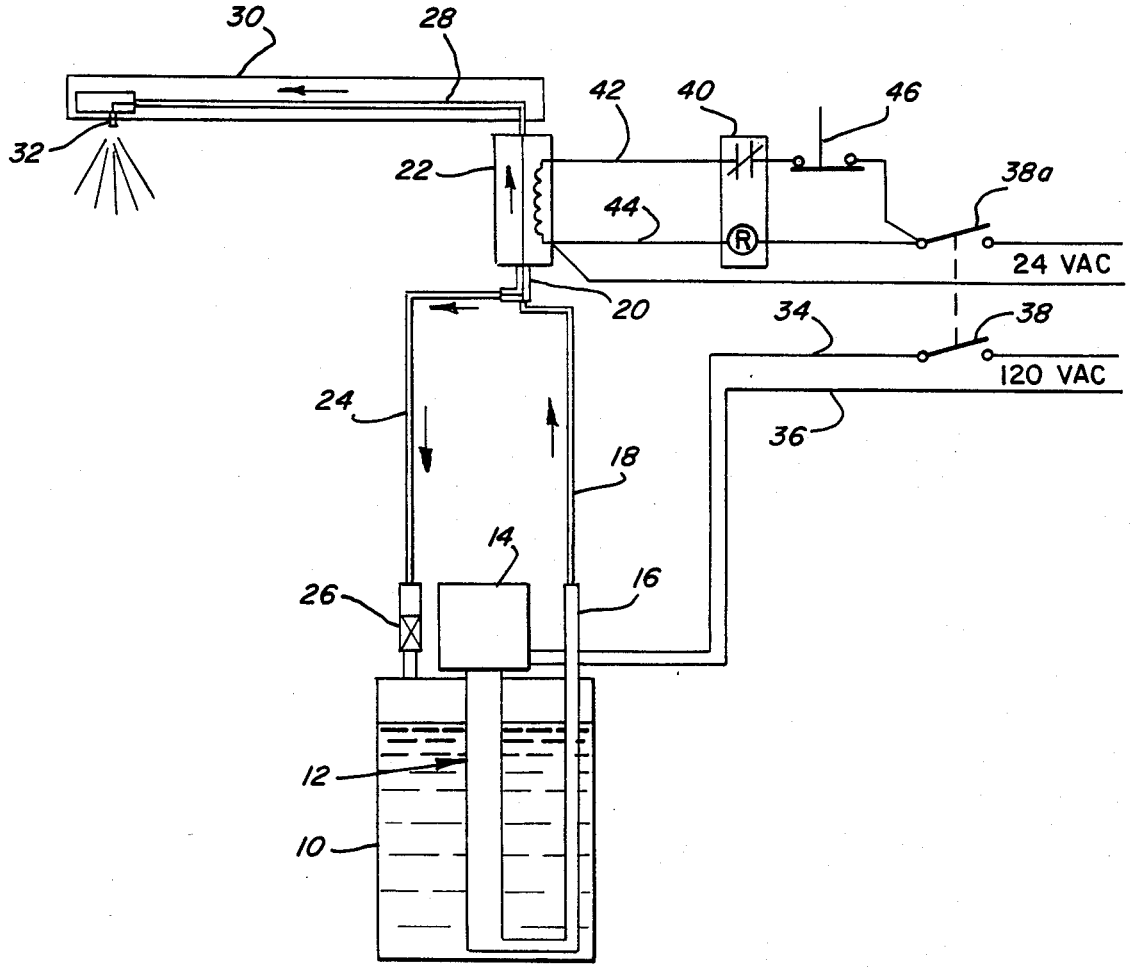
30
28
42
40
46
32
22
38a
44
24 VAC
20
34
38
120 VAC
24
36
18
14
16
26
12
10

ABRASIVE SLURRY SUPPLY SYSTEM FOR USE IN METALLOGRAPHIC SAMPLE PREPARATION

BRIEF SUMMARY OF THE INVENTION

The present invention relates to a system for supplying alumina or other abrasive slurry from a reservoir to an applicator arm for dispensing on a rotatable platen or lapping wheel or the like of apparatus used in the surface preparation of metallurgical samples. It is known in the art to use alumina or other abrasive slurry in the preparation of metallurgical samples, as in the polishing, grinding or lapping of the surfaces of such samples. However, such slurry is difficult to circulate, and if any settling out of the abrasive particles occurs they have a tendency to cause clogging of the system. It is desirable where possible to maintain such slurry in an agitated state continuously to prevent settling of the alumina particles, even though it is normally desirable to operate such a system intermittently by supplying abrasive slurry to the lapping apparatus only at timed intervals.

It is therefore an object of our invention to provide an alumina or other slurry supply system designed to continuously pump slurry from a reservoir to a conduit for recirculation to the reservoir, while utilizing timed valve means to determine when a selected portion of the slurry is to be conducted to an applicator arm for use in the preparation of metallurgical specimens.

Another object of the invention is to provide a slurry supply system as last above-mentioned including an applicator arm disposed at a higher elevation then the reservoir and conduit, and used in conjunction with a normally-open valve in the conduit which supplies the applicator arm, thereby permitting the applicator arm and conduit to drain back to the reservoir whenever the system is turned off.

Still another object of our invention is to provide improved means for controlling the volume and pressure of alumina slurry supplied to the applicator arm for use in the preparation of metallurgical specimens.

The foregoing and other objects and advantages of our invention will be apparent from the following description of a preferred embodiment, taken in conjunction with the accompanying drawing.

DESCRIPTION OF THE DRAWING

The drawing is a schematic drawing showing the main components of the alumina slurry supply system of the present invention.

Now, in order to acquaint those skilled in the art with the manner of making and using our invention, we shall describe, in conjunction with the accompanying drawing, a preferred embodiment of the invention.

DETAILED DESCRIPTION OF THE INVENTION

Referring now to the drawing, there is shown a reservoir 10 for containing a supply of alumina or other abrasive slurry for use in the surface preparation of metallurgical specimens. It will be understood such alumina slurry is known in the art for use in the preparation of metallurgical specimens, and that the slurry supply system of the present invention is also well adapted for use with other types of slurry utilized for such specimen preparation.

A recirculation pump 12 includes a pump motor 14 and an outlet tube 16 for pumping the abrasive slurry from reservoir 10 through a first conduit 18 to a tee fitting 20. The tee fitting 20 communicates both with a valve 22 and also with a second conduit 24. The conduit 24 leads back to the reservoir 10 through a globe valve 26. On the other hand, the valve 22 leads to a third conduit 28 of an applicator arm 30 having a nozzle 32 for spraying abrasive slurry to a rotatable lapping wheel or the like (not shown) of apparatus for the surface preparation of metallurgical specimens. The electric pump motor 14 is connected to a source of power through lines 34 and 36, and a switch 38 is provided for starting and stopping the pump.

When the slurry supply system of the present invention is on, pump 12 is operated continuously to pump the alumina slurry from the reservoir 10 through conduit 18. If valve 22 is closed, the entire amount of such slurry will be recirculated back through conduit 24 and valve 26 to the reservoir. The position of valve 26 may be varied, as will be described later herein, but it must of course be partly open to permit the recirculation of the slurry by pump 12 as described. When valve 22 is open, a portion of the slurry from conduit 18 will pass through valve 22 and third conduit 28 to the applicator arm nozzle 32 from which it will be dispensed to the sample preparation apparatus.

Valve 22 is a normally-open solenoid operated valve controlled by a timer 40. When timer 40 is "off", valve 22 is open, and alumina slurry is dispensed from applicator arm 30. When timer 40 goes "on", valve 22 closes and the supply of slurry to the arm 30 is cut off. The timer 40 is preferably set to be "off" for a predetermined fixed time, such as 0.5 seconds, whereas the ontime may be varied between 0.8 to 18 seconds. Thus, valve 22 is controlled to permit applicator arm 30 to produce intermittent dispenses of slurry, each spray lasting for a duration of 0.5 second, and the interval between such intermittent sprays may be varied from 0.8 to 18 seconds.

The solenoid operated valve 22 is controlled from an electrical power source through leads 42 and 44, and the foregoing circuit includes switch **38*a* which operates in conjunction with switch 38. Timer 40 and manual override switch 46 are also connected in the foregoing circuit. The timer 40 is of known type and is set for the desired interval which as indicated above is preferably in the range of 0.8 to 18 seconds, for example, 8 seconds. Thus, in the foregoing example, every 8 seconds the timer will go "off" to permit valve 22 to open, thereby causing slurry to be dispensed from applicator arm 30 for a duration of 0.5 second, the switches 38 and 38*a*** being closed during operation of the slurry supply system.

Whenever it is desired to supply additional slurry to the associated apparatus for surface preparation of metallurgical specimens, an operator need only manually open switch 46 to override the system and turn "off" the timer, thereby causing additional spray of slurry. Such an override of the timer may be desirable to load-up a lapping wheel with abrasive slurry at the beginning of a lapping operation.

One of the advantages of the slurry supply system of the present invention is that the slurry is continuously recirculated when the system is "on", thereby keeping the alumina particles in suspension and preventing settling out which tends to cause clogging of the system. By setting valve 26 in a selected position, it is possible to control the amount of slurry conducted to the applicator arm 30 and the amount of slurry which is recirculated, as well as the pressure of the slurry supplied to applicator arm 30. Thus, by opening valve 26, the amount of slurry conducted to arm 30 is reduced, as is the pressure of that slurry. On the other hand, by closing down valve 26, more slurry is conducted to applicator arm 30, and at a higher pressure.

It is also an advantage of the present system that applicator arm 30 is located at the highest point in the system, reservoir 10 is at the lowest point, and valve 22 is normally open. The result is that whenever the system is turned "off" by opening switches 38 and 38*a*, the alumina slurry is permitted to drain from the arm 30 and associated tubing back to reservoir 10, thereby minimizing settling and the creating of blockages in the passages.

It is also a feature of the present invention to provide timer 40 in conjunction with normally-open valve 22, so the timer's contactor opens periodically to permit valve 22 to open and cause a portion of abrasive slurry to be emitted from applicator arm nozzle 32. It will be noted that after the timer is set, it is activated at the same time that recirculation pump 14 is turned "on", through closing of switches 38 and 38*a*.

What is claimed is:

1. A slurry dispensing system for supplying a portion of abrasive slurry to apparatus for preparing the surface of metallurgical specimens, said system comprising, in combination, reservoir means for containing a supply of abrasive slurry, first conduit means leading from said reservoir means, pump means for pumping abrasive slurry from said reservoir means through said first conduit means, second conduit means leading from said first conduit means back to said reservoir means for recirculating abrasive slurry pumped by said pump means, third conduit means communicating with said first and second conduit means and including normally-open valve means leading to nozzle means for supplying a portion of abrasive slurry to said apparatus, said nozzle means being disposed at a higher level than said first and second conduit means, and said reservoir means being located at a lower level than said first and second conduit means, timer control means for closing said normally-open valve means at timed intervals, and means for operating said pump continuously whereby when said valve means is open at least a portion of the abrasive slurry pumped from said reservoir means will be dispensed for use with said apparatus, when said timer control means closes said valve means, all of the slurry pumped by said pump means will be recirculated to said reservoir means, and when said pump means is inoperative the abrasive slurry in said first, second and third conduit means will automatically drain back to said reservoir means.

2. A slurry dispensing system as defined in claim 1 where second valve means is connected in said second conduit means, said second valve means being adjustable to control the amount of abrasive slurry delivered to said nozzle means when said normally-open valve means is open, and for controlling the pressure of slurry delivered to said nozzle means.

3. A slurry dispensing system as defined in claim 1 where said control means comprises an electrically controlled timer which when energized serves to close said normally-open valve means.

4. A slurry dispensing system as defined in claim 3 where said timer is set to be "off" for a fixed predetermined time for controlling the duration of spray pulse from said nozzle means, and said timer is adjustable for variation of the "on" time which controls the interval between such sprays, thereby providing a fixed spray pulse at a variable frequency.

5. A slurry dispensing system as defined in claim 3 including first switch means for closing a circuit to energize said timer means, and second switch means for closing a circuit to energize said pump means, said first and second switch means being operable conjointly.

6. A slurry dispensing system for supplying a portion of abrasive slurry to apparatus for preparing the surface of metallurgical specimens, said system comprising, in combination, reservoir means for containing a supply of abrasive slurry, first conduit means leading from said reservoir means, pump means for pumping abrasive slurry from said reservoir means through said first conduit means, second conduit means leading from said first conduit means back to said reservoir means for recirculating abrasive slurry pumped by said pump means, third conduit means communicating with said first and second conduit means and including normally-open valve means leading to nozzle means for supplying a portion of abrasive slurry to said apparatus, said nozzle means being disposed at a higher level than said first and second conduit means, and said reservoir means being located at a lower level than said first and second conduit means, electrically-controlled timer means for closing said normally-open valve means at timed intervals, second valve means connected in said second conduit means and adjustable to control the amount of abrasive slurry delivered to said nozzle means when said normally-open valve means is open, and for controlling the pressure of slurry delivered to said nozzle means, and means for operating said pump continuously whereby when said normally-open valve means is open at least a portion of the abrasive slurry pumped from said reservoir means will be dispensed for use with said apparatus, when said electrically controlled timer means closes said normally-open valve means, all of the slurry pumped by said pump means will be recirculated to said reservoir means, and when said pump means is inoperative the abrasive slurry in said first, second and third conduit means will automatically drain back to said reservoir means.

7. A slurry dispensing system as defined in claim 6 where said electrically controlled timer means is set to "off" for a fixed predetermined time for controlling the duration of the spray from said nozzle means, and said timer means is adjustable for variation of the "on" time which controls the interval between such dispensings, thereby providing a fixed dispensing pulse at a variable frequency.

* * * * *